United States Patent [19]

Inoue

[11] Patent Number: 4,512,859

[45] Date of Patent: Apr. 23, 1985

[54] ABRASIVE POLISHING METHOD

[75] Inventor: Kiyoshi Inoue, Tokyo, Japan

[73] Assignee: Inoue-Japax Research Incorporated, Yokohama, Japan

[21] Appl. No.: 453,174

[22] Filed: Dec. 27, 1982

[30] Foreign Application Priority Data

Dec. 26, 1981 [JP] Japan ..... 56-214389

[51] Int. Cl.[3] ..... B24B 7/00

[52] U.S. Cl. ..... 204/129.46; 204/1 R; 204/DIG. 12; 51/2 R; 51/317

[58] Field of Search ..... 204/129.1, 129.46, 275, 204/129.7, DIG. 12, 1 R; 51/317, 318, DIG. 9, DIG. 22, 296, 297, 4, 396, 2 R

[56] References Cited

U.S. PATENT DOCUMENTS

| | | | |
|---|---|---|---|
| 2,346,228 | 4/1944 | Merrill et al. | 51/317 |
| 3,252,775 | 5/1966 | Tocci | 51/296 |
| 3,634,973 | 1/1972 | McCarty | 51/2 R |
| 3,728,821 | 4/1973 | Perry | 51/2 R |
| 3,816,291 | 6/1974 | Inoue | 204/224 M |
| 3,909,217 | 9/1975 | Perry | 51/298 |
| 4,124,453 | 11/1978 | Fleishmann et al. | 204/1 R |
| 4,221,572 | 9/1980 | Torimae et al. | 51/298 |
| 4,343,910 | 8/1982 | Busch, Jr. et al. | 521/82 |

*Primary Examiner*—Brian E. Hearn
*Assistant Examiner*—Nathan Thane
*Attorney, Agent, or Firm*—Karl F. Ross; Herbert Dubno

[57] ABSTRACT

A novel method of polishing a workpiece surface comprises passing over the surface in elastically compressive abrasive contact therewith a mass of discrete, elastically deformable pieces each individually consisting of a matrix of elastomeric material containing finely divided abrasive particles substantially uniformly distributed at least along a surface region of the individual piece.

16 Claims, 8 Drawing Figures

ABRASIVE POLISHING METHOD

FIELD OF THE INVENTION

The present invention relates to a polishing method and, more particularly, to a new and improved method of abrasively polishing a surface, for example, a shaped die or mold surface.

BACKGROUND OF THE INVENTION

In a conventional surface polishing process, a fluid such as air or liquid which carries abrasive particles in suspension may be forced against a surface to be finished. To cause the particles to achieve satisfactory abrading actions, the carrier fluid must be forced to flow at a relatively high velocity. The use of the high velocity, however, makes it possible to polish relatively convex surface areas only and has practically no effect on surfaces which are relatively concave or recessed. Difficulties in abrasively polishing recessed areas have also been experienced in another conventional process which utilizes a belt made of an elastomeric material containing abrasive grains distributed therein.

In a further conventional polishing process, a semi-solid, highly viscous plastic material such as silicone putty may carry abrasive particles therein and be forced to flow at a relatively low velocity in abrasive contact with a surface to be polished (cf. U.S. Pat. No. 3,521,412, issued July 21, 1970). This process requires both greater plasticity and lesser pliability or greater stiffness of the carrier medium in the interest of increasing the abrading ability. This requirement necessarily makes the medium and the abrasive particles carried therein difficult to flow or to move, necessitating an extremely high pressure to force the same to pass over the surfaces. As a result there is an undesirable limitation in the polishing efficiency and ability. Furthermore, the uniformity of polishing which can be achieved in this process has been found to be unsatisfactory. Due to its high viscosity and plasticity, coupled with lack of pliability, the abrasive carrier medium tends to dwell in recessed areas.

OBJECTS OF THE INVENTION

It is accordingly an important object of the present invention to provide a novel and improved surface polishing method which is capable of abrasively polishing a surface, which may be highly intricate in shape, with greater efficiency and uniformity of polishing than with the conventional processes.

Another important object of the present invention is to provide a method as described which can readily be practiced with an existing equipment.

A further object of the invention is to provide a method as described in which the polishing rate is further enhanced by combining the abrasive action with electrochemical material removal action.

SUMMARY OF THE INVENTION

In accordance with the present invention there is provided a method of abrasively polishing a surface, which method comprises compressively passing over the surface in abrasive contact therewith, a mass of discrete, elastically deformable pieces each individually consisting of a matrix of elastomeric material containing finely divided abrasive particles distributed substantially uniformly throughout at least a surface region of the individual piece. Preferably, the discrete pieces each individually have a piece size ranging between 0.1 and 5 mm and contain abrasive particles in the individual matrix at a proportion of 10 to 80% by volume under an atmospheric pressure. Specifically, the said matrix may consist at least in part of a synthetic or natural rubber, and may consist at least in part of at least one elastomeric substance selected from the group which consists of polyethylene, butylal resin, silicone resin, nitrylbutadiene resin, methylmelamine resin, acetal resin, phenolformaldehyde resin, urea resin and/or epoxy resin. Preferably, the said abrasive particles have particle sizes ranging between 5 and 500 $\mu$m and are contained in the said matrix in a proportion of 10 to 80% by volume under atmospheric pressure.

In accordance with a further important feature of the present invention, at least a portion of the said finely divided particles consists of electrically conductive abrasive particles and said mass contains an electrolyte, and the method further comprises passing an electrochemical machining current across at least a portion of said mass compressively passing over said surface through said electrolyte to electrolytically dissolve material from the said surface, thereby increasing the rate of polishing said surface. The said electrically conductive abrasive particles may be composed at least in part of at least one substance selected from the group which consists of silicon carbide, titanium nitride, titanium carbide, boron carbide and titanium borides. It has also been found to be desirable that the said discrete, elastically deformable pieces each individually further contain electrically conductive particles composed of at least one substance selected from the group which consists of nickel, carbon, iron, chromium and aluminum.

BRIEF DESCRIPTION OF THE DRAWING

These and other features of the present invention as well as advantages thereof will become more readily apparent from a reading of the following description of certain preferred embodiments thereof when made with reference to the accompanying drawing in which.

SPECIFIC DESCRIPTION

Figure 1A:
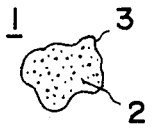
FIGS. 1A, 1B, 1C, 1D, 1E and 1F are diagrammatic illustrative views showing various shapes of elastically deformable pieces which can be used in the practice of a method according to the present invention.
Figure 1B:
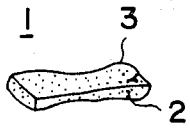
Figure 1C:
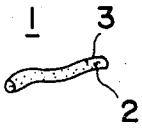
Figure 1D:
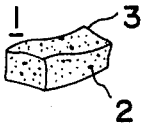
Figure 1E:
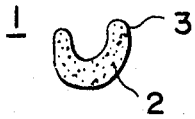
Figure 1F:
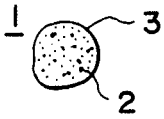
Figure 2:
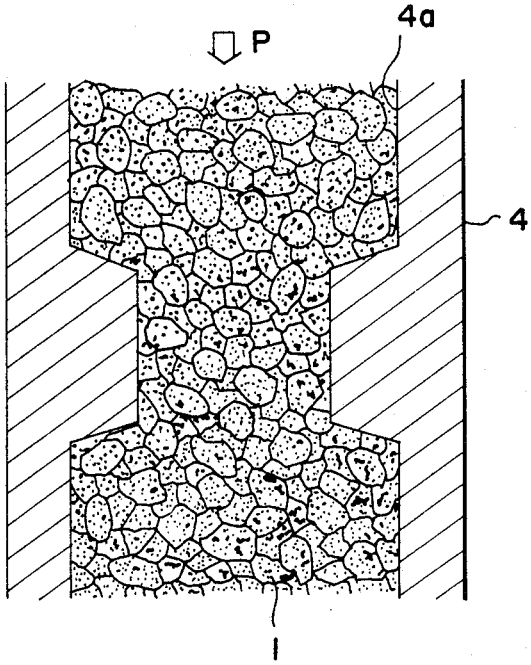
FIG. 2 is a diagrammatic illustrative view in section, showing one made of practicing a method according to the present invention.

As shown in FIGS. 1A through 1F, each individual discrete elastically deformable piece 1 consists of a matrix of elastomeric material 2 and finely divided abrasive particles 3 distributed therein, and may be in the form of a chip or a fragment (FIG. 1A), a severed rod or band (FIG. 1B), a severed wire (FIG. 1C), a rectangle or prism (FIG. 1D), an arc or crescent (FIG. 1E), a sphere (FIG. 1F) or any other form. In the practice of the method according to the invention, a mass of discrete pieces 1 of one or more in combination of such forms is prepared and, as shown in FIG. 2, is compressively under a pressure P, passed over surfaces **4*a* of a workpiece 4** in a compressive abrasive contact therewith.

According to a preferred embodiment of the present invention, the piece size of each piece 1 ranges between 0.1 and 5 mm. It has been found to be desirable that the piece size range from one half or one third to one twentieth and, preferably, from one third or one fourth to one tenth of the size of the minimum significant recess or projection on the surface 4*a* of the workpiece 4.

The elastomeric material constituting the matrix 2 of each discrete piece 1 may be natural or synthetic rubber and may be high polymeric polyethylene, butylal resin, silicone resin, nitrylbutadiene resin, methylmelamine resin, acetal resin, phenolformaldehyde resin, urea resin or epoxy resin. Abrasive particles 3 may be composed of titanium carbide (TiC), titanium nitride (TiN), titanium oxide ($TiO_2$), boron carbide ($B_4C$), boron nitride (BN), silicon carbide (SiC), silicon nitride ($Si_3N_4$), alumina ($Al_2O_3$), zirconium oxide ($ZrO_2$), diamond or any other conventional abrasive substance and may have a particle size ranging between 5 and 500 μm. The abrasive particles 3 may be contained in the matrix at a proportion of 10 to 80% by volume under atmospheric pressure.

Figure 3:
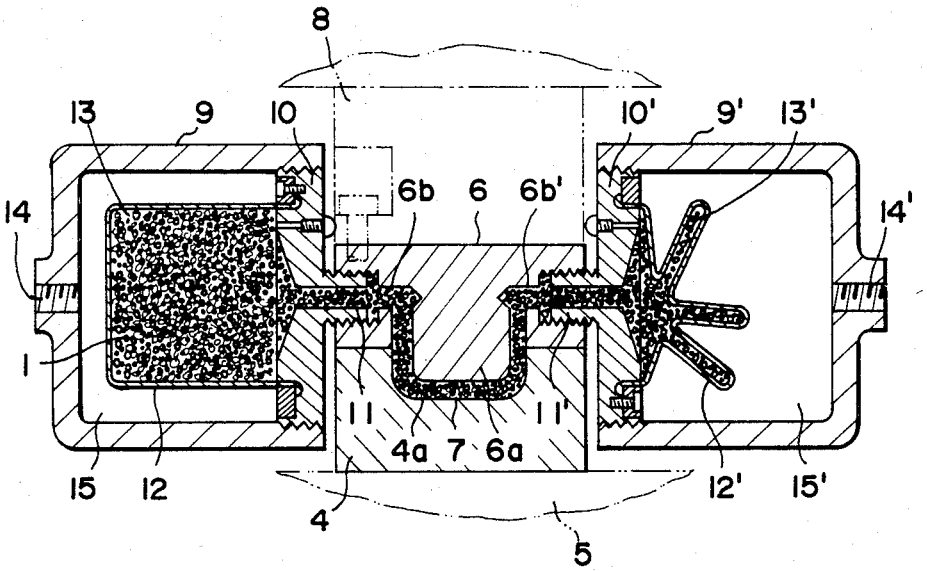
FIG. 3 is a diagrammatically illustrative view showing in section an apparatus which can be employed in practicing a method according to the present invention.

In FIG. 3 there is shown an apparatus for carrying out the method of the present invention. The apparatus includes a base 5 on which a workpiece 4 is fixedly mounted. The workpiece which may be a die or mold has a machined recess which is open upwardly and of which the surface 4*a* is to be polished. A block 6 having a projection 6*a* which is complementary in shape with the recessed surface 4*a* is securely mounted on the workpiece 4 so as to establish a mating relationship therewith and to provide a spacing 7 between the projection 6*a* and the recessed surface 4*a* disposed in a parallel relationship therewith. The block 6 is clamped against the workpiece 4 by a press 8.

Disposed at opposite sides of the block 6 are pressure vessels 9 and 9' which are secured thereto by means of caps 10 and 10', respectively. The vessels 9 and 9' are equipped to accept collapsible bags 12, 12' constructed of a deformable diaphragms and clamped to the caps 10 and 10', respectively. The caps 10 and 10' are centrally formed with bores 11 and 11' each of which serves as an orifice for communicating the chambers 13, 13' formed within the respective bags 12, 12' with the spacing 7 via the passageways 6*b* and 6*b'*, respectively. The compartments 15 and 15' defined within the pressure vessels 9, 9' are alternately supplied with a pressure fluid via passages 14 and 14', respectively.

Prior to a polishing operation, a mass of discrete, elastically deformable pieces 1 as described hereinbefore is loaded into one of the bags 9 and 9', possibly also into the other. When the two bags are loaded and one of them is fully loaded, it is essential that the other be only partially loaded with these pieces 1. In FIG. 3, such a mass of discrete pieces is shown as continuously extending over the orifices 11, 11', the passageways, 6*b*, 6*b'* and the spacing 7 and fully filling one bag 12 and partially filling the other 12'. It is essential that the workpiece 4 and the elements 6, 8, 10, 10' and 12, 12' be arranged so as to avoid any leakage of the pieces 1 from the confined passages 12, 11, 6*b*, 7, 6*b'*, 11' and 12'.

In operation, one pressure compartment 15 may be supplied with pressure fluid, e.g. oil, via the inlet 14 to compress the bag 12 filled fully with the mass of discrete, elastically deformable pieces 1. These discrete pieces 1 are thereby forced progressively out of the bag 12 and forced to pass over the recessed surface area 4*a* of the workpiece 4 in a elastically compressive abrasive contact therewith, and eventually collected in the other bag 12'. As a result, the bag 12' is progressively inflated to force the fluid in the compartment 15' out through the outlet 14'. When the bag 12 is collapsed and the bag 12' is filled up with the discrete pieces 1, the cycle is reversed. Then the pressure fluid is supplied into the compartment 15 to compress the bag 12', thus causing the discrete pieces 1 progressively to leave the bag 12', to pass over the surface area 4*a* in elastically compressive abrasive contact therewith and to reach the bag 12. By repeating this reciprocatory cycle, the recessed workpiece surface 4*a* is thoroughly and uniformly polished.

Preferably, the abrasive particles contained in the matrix 2 of each such piece 1 are constituted by electrically conductive abrasive particles which may be composed of silicon (Si), titanium nitride (TiN), titanium carbide (TiC), boron carbide ($B_4C$) and/or titanium borides (TixBy). The mass 1 of pieces may then contain a liquid electrolyte such as an aqueous solution containing 3% by weight sodium chloride. The block 6 is typically a metal and is electrically connected to the negative terminal of a power supply (not shown) while the workpiece 4 which is metallic is connected to the positive terminal of the power supply. Of course, a suitable electrical insulation is provided between the conductive block 6 and the conductive workpiece 4. An electrochemical machining current is passed between the block 6 and the workpiece 4 across the spacing 7 compressively traversed by a mass of the discrete, elastically deformable pieces 1 to electrolytically polish the surface 4*a* lying against the electrically abrasive particles.

It will be understood that the aforedescribed means for moving the mass of discrete pieces 1 over the surface 4*a* may be replaced by any other conventional means such as an extruder device utilizing a piston and cylinder set or a rotary extruding machine.

It should be apparent that the method of the present invention provides a highly efficient and capable surface polishing process. Abrasive particles 3 are firmly and yet resiliently supported in the elastic matrix 2 of each of the pieces 1 which are individually discrete and caused to individually compressively flow in a mass. Deformed individually under pressure, each piece 1 stores potential energy and, when passing over the workpiece surfaces 4*a*, brings the abrasive particles projecting from the surface region of the matrix 2 into compressive abrasive contact therewith. Because the abrasive particles 3 are retained in their positions in the solid and elastic matrix 2, they do not enter deeply under compressive pressure into the matrix 2 as with the conventional process utilizing a continuous putty-like matrix, and hence, when frictionally passing over the surfaces 4*a*, the matrixes effectively hold particles in abrasive contact therewith. Furthermore, the elastic and solid matrixes are inherently repulsive so that they are held against dwelling in certain recessed areas in the surface 4*a* to be polished. The flowing discrete, elastically deformable pieces 1 also tend to establish a dynamic elastic equilibrium in a mass. By virtue thereof, uniformity of polishing over the entire areas of the surface 4*a* is effectively achieved, even though the surface to be polished is intricate.

What is claimed is:

1. A method of polishing a surface, comprising the steps of:

preparing an amount of discrete, individually elastically deformable pieces, each of which individually consists of a matrix of elastomeric material containing finely divided abrasive particles distributed substantially uniformly throughout at least a surface region of the individual pieces; and passing said discrete, elastically deformable pieces in an aggregate compressively over said surface in frictional abrasive contact therewith while substantially maintaining a pressure-contacting and elastically deformable relationship between the individual pieces.

2. The method defined in claim 1 wherein said surface is spacedly juxtaposed with a block and said aggregate of the discrete pieces is compressively passed through a spacing between said block and said surface.

3. The method defined in claim 2 wherein said block is formed with a surface complementary in shape with said surface to be polished.

4. The method defined in claim 2 or 3 wherein said aggregate is reciprocatingly passed through said spacing.

5. The method defined in claim 1 or claim 2 wherein said surface to be polished includes a formed recess to be finished without substantially impairing a form thereof.

6. The method defined in claim 5 wherein the piece size of said individual pieces is in a range between one twentieth and one half of a minimum size of said recess.

7. The method defined in claim 6 wherein said range lies between one tenth and one third of said minimum size.

8. The method defined in claim 1 wherein said discrete, elastically deformable pieces each individually have a piece size ranging between 0.1 and 5 mm.

9. The method defined in claim 1 wherein said discrete, elastically deformable pieces each individually contain said abrasive particles in said matrix at a proportion ranging between 10 and 80% by volume.

10. The method defined in claim 1 wherein said aggregate is of a predetermined quantity.

11. The method defined in claim 1 wherein said matrix consists at least in part of a synthetic or natural rubber.

12. The method defined in claim 1 wherein said elastomeric matrix contains at least in part at least one elastomeric substance selected from the group which consists of polyethylene, butylal resin, silicone resin, nitrylbutadiene resin, methylmelamine resin, acetal resin, phenolformaldehyde resin, urea resin and epoxy resin.

13. The method defined in claim 1 wherein said abrasive particles have particle sizes ranging between 5 and 500 μm and are contained in said matrix at a proportion of 10 to 80% by volume.

14. The method defined in claim 1 wherein at least a portion of said finely divided particles consists of electrically conductive abrasive particles and said aggregate contains an electrolyte, said method further comprising passing an electrochemical machining current across at least a portion of said aggregate compressively passing over said surface through said electrolyte to electrolytically dissolve material from said surface, thereby increasing the rate of polishing said surface.

15. The method defined in claim 14 wherein said electrically conductive abrasive particles are composed at least in part of at least one substance selected from the group which consists of silicon, titanium nitride, titanium carbide, boron carbide and titanium borides.

16. The method defined in claim 15 wherein said discrete, elastically deformable pieces each individually further contain electrically conductive particles composed of at least one substance selected from the group which consists of nickel, carbon, iron, chromium and aluminum.

* * * * *